United States Patent [19]

Lang

[11] Patent Number: 4,678,089

[45] Date of Patent: Jul. 7, 1987

[54] DISPLAY STAND

[75] Inventor: Franz J. Lang, Kelkheim, Fed. Rep. of Germany

[73] Assignee: Display-Design GmbH für moderne Verkaufsförderungsmittel und Raumausstattung, Kelkheim, Fed. Rep. of Germany

[21] Appl. No.: 749,309

[22] Filed: Jun. 27, 1985

[30] Foreign Application Priority Data

Aug. 2, 1984 [DE] Fed. Rep. of Germany ..... 3428554

[51] Int. Cl.[4] ..... A47F 3/14

[52] U.S. Cl. ..... 211/133; 211/205; 108/144; 248/523

[58] Field of Search ..... 211/133, 205, 207; 108/106, 144; 248/523

[56] References Cited

U.S. PATENT DOCUMENTS

| | | | |
|---|---|---|---|
| 1,581,463 | 4/1926 | Moors | 211/207 |
| 2,447,924 | 8/1948 | Vitale | 211/205 |
| 3,236,389 | 2/1966 | Murdock | 211/133 |
| 3,414,133 | 12/1968 | Guerri et al. | 211/133 |
| 3,675,598 | 7/1972 | Kesilman et al. . | |
| 4,057,665 | 11/1977 | Szulewski | 211/205 X |
| 4,126,963 | 11/1978 | Dunbar | 248/523 X |
| 4,159,096 | 6/1979 | Chase | 248/523 |
| 4,261,138 | 4/1981 | St. George Syms | 248/523 X |

FOREIGN PATENT DOCUMENTS

| | | | |
|---|---|---|---|
| 135665 | 2/1902 | Fed. Rep. of Germany . | |
| 1235512 | 5/1960 | France | 211/133 |
| 1307004 | 9/1962 | France . | |
| 2224013 | 10/1974 | France . | |
| 294782 | 8/1928 | United Kingdom | 211/207 |
| 1129594 | 10/1968 | United Kingdom . | |

*Primary Examiner*—Ramon S. Britts
*Assistant Examiner*—Blair Johnson
*Attorney, Agent, or Firm*—Toren McGeady and Associates

[57] ABSTRACT

In a display stand comprising a pedestal, a carrier column and a goods carrier secured to the carrier column, it is proposed that the goods carrier is fixed to the carrier column in that a wedge engagement sleeve engages from beneath in a wedge engagement tube of the goods carrier.

10 Claims, 17 Drawing Figures

16
10r
12
10e
10a 10a
10b
10n
10k
10g
10i
10a
10e
10m
10c
10l
III
10p
12
10d
10
10h 14
14a
14b
14c
14d
14e
12
12a
12'
12'b
14'f
14'
18
18a
18b
V
VI
VII

DISPLAY STAND

BACKGROUND TO THE INVENTION

The invention relates to a display stand comprising a pedestal, a carrier column supported by the pedestal, and at least one goods carrier secured on the carrier column.

STATEMENT OF THE INVENTION

Such display stands are used especially for the display of special ranges of goods in sales premises, such as department stores. With regard to the storage of the display stands by the users and their transport to the users, pedestal, carrier column and goods carrier are made separable from one another, so that they can be accommodated in minimum space. It is therefore of essential importance that the individual parts, namely pedestal, carrier column and goods carrier, can be connected with one another in a stable manner, so that even when loaded they hold together without danger of disengagement from one another and do not assume any askew position in relation to one another.

OBJECT OF THE INVENTION

An object of the invention is to provide a durable connection especially between the carrier column and the goods carrier, guaranteeing an unambiguous orientation of the goods carrier in relation to the carrier column.

SUMMARY OF THE INVENTION

To solve this problem it is proposed in accordance with the invention that the goods carrier is seated with a downwardly open wedge engagement tube on an upwardly converging wedge engagement sleeve which surrounds the carrier column in clamping manner.

In the form of embodiment according to the invention the retention and orientation of the goods carrier in relation to the carrier column become the better, the greater is the loading of the goods carrier, because the wedge engagement tube and the wedge engagement sleeve are pushed still more into one another by the loading and the wedge engagement sleeve is applied more strongly to the carrier column.

In principle it is conceivable for the vertical fixing of the wedge engagement sleeve on the carrier column to be effected exclusively by the clamping of the wedge engagement sleeve with the carrier column. However with regard to increased security against axial displacement it will be preferable to support the wedge engagement sleeve downwards by a support element which can be made fast on the carrier column. In principle this support element can be integrated into the wedge engagement sleeve, but according to a preferred form of embodiment it is a separate component. This support element can be formed by a ring grasping around the carrier column and a screw penetrating this ring.

The wedge engagement sleeve is expediently slotted so that with little application of force it can be narrowed and thus clamped fast upon the carrier column.

Beside round goods carriers, non-circular goods carriers are frequently used. These must be fixed in their angular position in relation to one another and in relation to the pedestal. This can take place in a manner in which the carrier column possesses at least one profile section departing from the circular cross-sectional form and the goods carrier correspondingly has a matching profile section. This profile section is preferably formed so that it is optically as inconspicuous as possible; this is most easily achieved by a flat facet extending for example over a center angle of 60° to 90°. Since the wedge engagement sleeve is preferably slotted in any case, it is possible to bring a rotation-preventing projection of the goods carrier in each case through the slot of the wedge engagement sleeve into engagement with a groove or flat facet of the carrier column.

It is also conceivable merely to provide a marking extending along a generatrix on the carrier column, and counter-markings on the goods carriers which are adjusted to the marking line in assembly.

The pedestal can be assembled from at least two storied pedestal pieces, namely a base pedestal and an upper pedestal, and at least one of the storied pedestal pieces can be formed for use without the other. In this way it is possible to obtain various forms of storied pedestal pieces with moderate tool expenditure for the production.

A pedestal or base pedestal can be formed with a carrier column reception pit which possesses a fixing projection at its bottom for engagement in the lower open end of the carrier column and is covered at its top by a centering washer which has a centering opening closely surrounding the carrier column and is fixed to the pedestal. In this way the carrier column can be held fast exactly vertically and immovably in the pedestal. The centering washer can here be connected with the pedestal at the upper end of the carrier column reception pit in bayonet catch manner.

The carrier column can be assemblable from individual carrier column sections. In this way the transport and storage problems are further simplified.

BRIEF DESCRIPTION OF DRAWINGS

The invention is explained by reference to an example of embodiment by the accompanying Figures, wherein.

Figure 1:
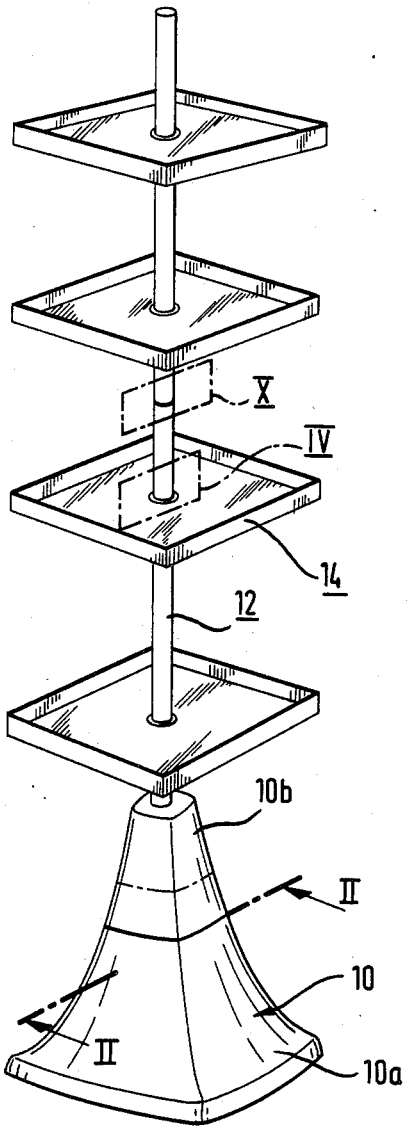
FIG. 1 represents an overall view of a display stand according to the invention.

The display stand consists according to FIG. 1 of a pedestal 10, a hollow carrier tube or column 12 and goods carriers 14.

DESCRIPTION OF THE PREFERRED EMBODIMENTS

Figures 2, 3:
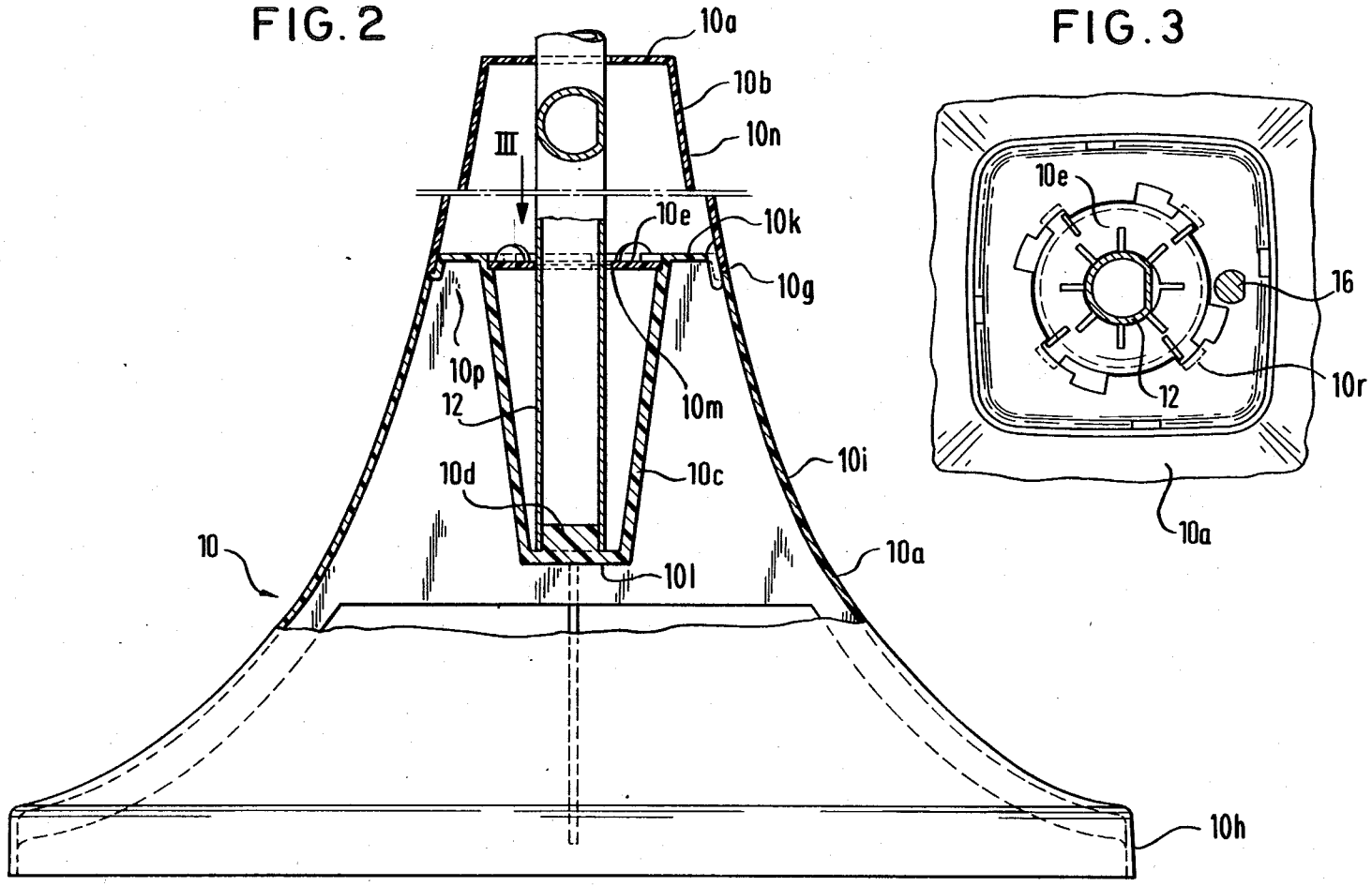
FIG. 2 represents a section along the line II—II through the pedestal.
FIG. 3 represents a plan view of the lower storied pedestal, that is the base pedestal, in the direction of the arrow III in FIG. 2.

The pedestal 10 consists according to FIG. 2 of a base pedestal part 10*a* and a top pedestal part 10*b*. The two parts, base pedestal part 10*a* and top pedestal part 10*b* adjoin one another in such a way that the junction is noticeable only as a narrow line, which can also be interpreted as a decorative line, or not at all. The base pedestal part 10*a* comprises a base portion 10*b*, a sleeve portion 10*i* tapering upwardly from the base portion 10*b*, and an upper transversal wall 10*k*. The transversal wall 10*k* has a downwardly tapering carrier column reception pit 10*c* with a bottom wall 10*l* and an upwardly directed fixing projection 10*d* which corresponds to the internal cross-section of the carrier column 12. The top pedestal part has an upwardly extending sleeve portion 10*n* and an upper terminal wall 10*o*. The sleeve portion 10*n* forms a smooth upwardly tapering continuation of the sleeve portion 10*i* of the base pedestal part 10*a*. The sleeve portion 10*n* has a lower edge portion 10*a* received by an inwardly recessed fixation step 10*p* located adjacent the upper end of the sleeve portion 10*i*. If the carrier column is non-circular as represented in FIG. 2, on the upper side of the base pedestal part 10*a* an orientation mark 16 is provided which indicates to the user in assembly in which angular orientation the carrier column must be introduced into the carrier column reception pit 10*c* in order to be fitted on to the fixing projection 10*d*. At the upper end of the carrier column reception pit 10*c* there is provided a centering washer 10*e* which is fitted by a bayonet catch means 10*r* on the upper end of the carrier column reception pit 10*c* and closely surrounds the carrier column 12. The centering washer 10*e* has a central opening 10*m* arranged to receive the outer cross-sectional shape of the carrier column.

Figures 4, 5, 6, 7, 8, 9, 10:
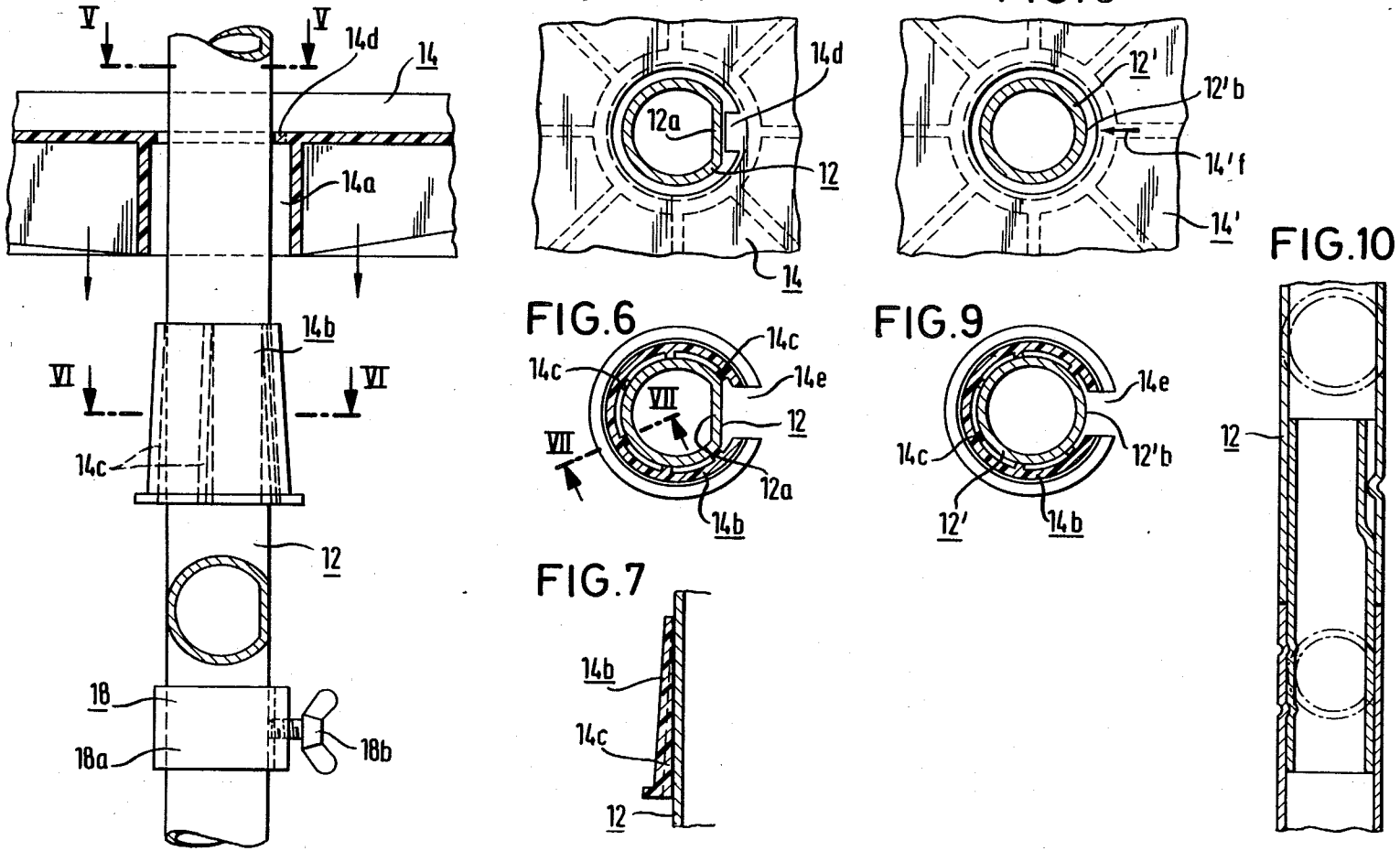
FIG. 4 represents an exploded view of the securing of a goods carrier on the carrier column in the detail IV according to FIG. 1.
FIG. 5 represents a plan view in the direction of the arrows V—V in FIG. 4 of the central part of a goods carrier.
FIG. 6 represents a section along the line VI—VI in FIG. 4.
FIG. 7 represents a section along the line VII—VII in FIG. 6.
FIG. 8 represents a modified form of embodiment in which the angle adjustment is effected by optical marks.
FIG. 9 represents a section corresponding to that of FIG. 6 in the form of embodiment according to FIG. 8.
FIG. 10 represents the connection of two successive sections of the carrier column and FIGS. 11 to 17 represent the display stand with different goods carriers.
Figure 11:
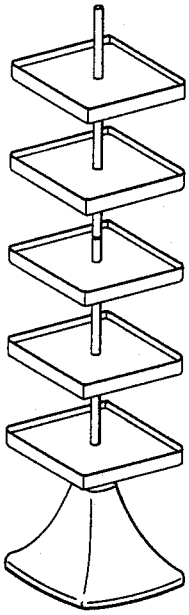
Figure 12:
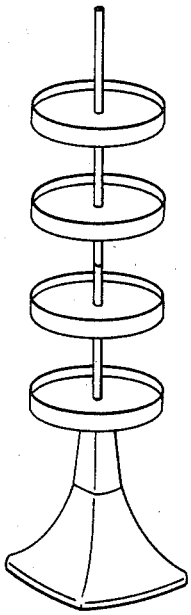
Figure 13:
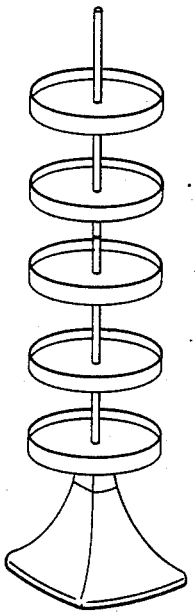
Figure 14:
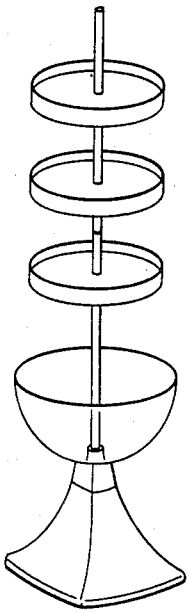
Figure 15:
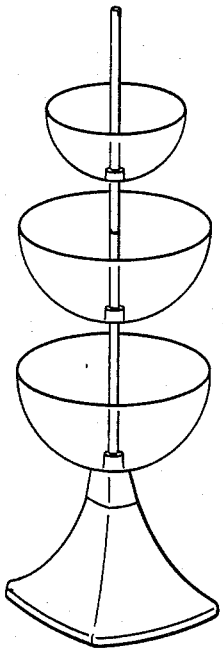
Figure 16:
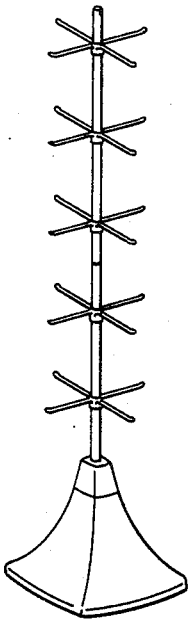
Figure 17:
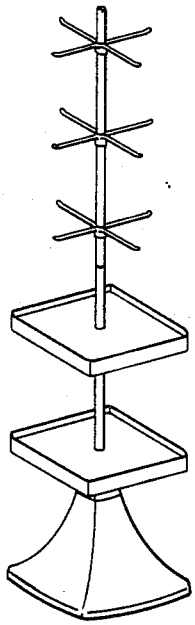

According to FIG. 4 a goods carrier 14 comprises a wedge engagement tube 14*a* which receives a wedge engagement sleeve 14*b*. As may be seen from FIG. 6, the wedge engagement sleeve 14*b* is slotted and encloses the carrier column 12, on which it rests through ribs 14*c*. After the wedge engagement sleeve 14*b* has been pushed into the wedge engagement tube 14*a* the goods carrier is firmly seated non-shiftably on the carrier column 12. In addition for protection against displacement a support element 18 can be provided which is formed by a ring 18*a* surrounding the carrier column and a clamp screw 18*b*. A projection 14*d* of the goods carrier 14 securing against rotation engages through a slot 14*e* of the wedge engagement sleeve 14*b* with a flat facet 12*a* of the carrier column 12. Thus the angle position of the goods carrier 14 in relation to the carrier column 12 is unambiguously fixed.

According to the alternative form of embodiment in FIGS. 8 and 9 a line 12′*b* is scored on the carrier column 12′. A marking arrow 14′*f* is provided on the goods carrier 14′ and is directed with its point to the marking line 12′*b*, so that in this way a simple angle adjustment of the goods carrier is also possible.

FIG. 10 shows how successive sections of the carrier column are fitted together telescopically.

FIGS. 11 to 17 show display stands according to the invention with various goods carriers, the goods carriers being adjusted in angle in each case in relation to one another and to the pedestal.

I claim:

1. A display stand comprising a pedestal (10), a carrier column (12) supported by the pedestal (10) and at least one goods carrier (14) secured on the carrier column (12), said pedestal (10) comprising a lower part (10*a*) and an upper part (10*b*), said lower part (10*a*) having a base portion (10*h*) and an upwardly tapered sleeve portion (10*i*) above said base portion (10*h*), said tapered sleeve portion (10*i*) being provided with an upper transversal wall having a central opening (10*k*), said upper transversal wall (10*k*) being provided in a central part thereof with a downwardly tapered reception pit (10*c*), said reception pit (10*c*) being provided with an upper ledge and a bottom wall (10*l*) at the lower end thereof, said bottom wall (10*l*) being provided with an upwardly directed projection (10*d*), a detachable centering washer (10*e*) covering the upper end of said column reception pit (10*c*), said centering washer (10*e*) having lateral peripheral extensions which pass downwardly through corresponding slots in the edge of the transversal wall central opening, wherein upon rotation of said washer, said extensions are misaligned from said slots thereby locking said washer between the transversal wall and said upper ledge; to the upper end of said carrier column reception pit (10*c*) on about the level of said upper transversal wall (10*k*) by bayonet catch means, said centering washer (10*e*) having a central opening (10*m*), said carrier column being a hollow tube having an inner cross-sectional area receiving said fixing projection (10*d*) and an outer cross-sectional area received by said central opening (10*m*) of said centering washer (10*e*), said upper part (10*b*) having a sleeve portion (10*n*) and an upper terminal wall (10*o*), said sleeve portion (10*n*) of said upper part (10*b*) being a smooth upwardly tapered continuation of said sleeve portion (10*i*) of said lower part (10*a*), an inwardly recessed fixation step (10*p*) being provided adjacent the upper end of said tapered sleeve portion (10*i*) of said lower part (10*a*), said tapered sleeve portion (10*n*) of said upper part (10*b*) having a lower edge portion (10*q*), said lower edge portion (10*q*) being received by said inwardly recessed fixation step (10*p*).

2. A display stand according to claim 1, wherein an upwardly converging wedge engagement sleeve clamps around the carrier column; and a downwardly open wedge engagement tube of said at least one goods carrier is seated on said wedge engagement sleeve.

3. A display stand according to claim 1, wherein the wedge engagement sleeve is downwardly supported by a support element which can be made fast on the carrier column.

4. A display stand according to claim 3, wherein the support element is a component separate from the wedge engagement sleeve.

5. A display stand according to claim 4, wherein the support element comprises a ring grasping around the carrier column and a clamp screw penetrating the ring.

6. A display stand according to any one of claims 1, 3 or 5, wherein the wedge engagement sleeve is slotted.

7. A display stand according to one of claims 1, 3, 4 or 5 where the goods carrier is fixed in angle about the axis of the carrier column.

8. A display stand according to claim 7, wherein the carrier column having a partly circular cross-sectional form and at least one profile section deviating from the circular cross-sectional form and the goods carrier correspondingly possesses a matching profile section.

9. A display stand according to claim 8, wherein a projection securing the goods carrier against rotation is in engagement, through the slot of the wedge engagement sleeve, with a groove of the carrier column.

10. A display stand according to claim 8, wherein a projection securing the goods carrier against rotation is in engagement, through the slot of the wedge engagement sleeve, with a flat facet of the carrier column.

* * * * *